US007503941B2

(12) United States Patent
Hamano et al.

(10) Patent No.: US 7,503,941 B2
(45) Date of Patent: Mar. 17, 2009

(54) ELASTIC FABRIC AND PROCESS FOR PRODUCING THE SAME

(75) Inventors: Akira Hamano, Otsu (JP); Akira Nishimoto, Otsu (JP); Seishyu Hayashi, Otsu (JP); Yasuo Ohta, Otsu (JP); Rajen M. Patel, Lake Jackson, TX (US); Rona L. Reid, Houston, TX (US); Antonio Batistini, Adliswil (CH)

(73) Assignee: Toyo Boseki Kabushiki Kaisha, Osaka (JP)

( * ) Notice: Subject to any disclaimer, the term of this patent is extended or adjusted under 35 U.S.C. 154(b) by 77 days.

(21) Appl. No.: 11/812,460

(22) Filed: Jun. 19, 2007

(65) Prior Publication Data

US 2007/0243785 A1 Oct. 18, 2007

Related U.S. Application Data

(62) Division of application No. 10/521,251, filed as application No. PCT/JP03/09077 on Jul. 17, 2003, now abandoned.

(30) Foreign Application Priority Data

Jul. 18, 2002 (JP) ..... P2002-209860

(51) Int. Cl.

| | |
|---|---|
| ***D06M 23/00*** | (2006.01) |
| ***D06C 3/00*** | (2006.01) |
| ***D03D 15/00*** | (2006.01) |
| ***D04B 9/00*** | (2006.01) |
| ***D04H 1/00*** | (2006.01) |

(52) U.S. Cl. ..... 8/494; 26/51; 442/181; 442/304; 442/328

(58) Field of Classification Search ..... 442/181, 442/304, 328; 8/494; 26/51
See application file for complete search history.

(56) References Cited

U.S. PATENT DOCUMENTS

| | | | | |
|---|---|---|---|---|
| 4,452,607 | A * | 6/1984 | Wessely | 8/497 |
| 2002/0064653 | A1* | 5/2002 | Ladika et al. | 428/364 |

FOREIGN PATENT DOCUMENTS

| | | | |
|---|---|---|---|
| JP | 60-59172 | A | 4/1985 |
| JP | 63-135559 | A | 6/1988 |
| JP | 1-162814 | A | 6/1989 |
| JP | 05-044138 | A | 2/1993 |
| JP | 05-125658 | A | 5/1993 |
| JP | 07-305284 | A | 11/1995 |
| JP | 08-120560 | A | 5/1996 |
| JP | 8-509530 | A | 10/1996 |
| JP | 9-291415 | | 11/1997 |
| JP | 11-021761 | A | 1/1999 |
| JP | 11-200125 | A | 7/1999 |
| JP | 2002-515530 | A | 5/2002 |
| JP | 2002-517545 | A | 6/2002 |
| JP | 2005-520066 | A | 7/2005 |
| WO | WO 94/25647 | | 11/1994 |
| WO | WO 99/60060 | | 11/1999 |
| WO | WO 99/63021 | | 12/1999 |
| WO | WO 01/85843 | | 11/2001 |

* cited by examiner

*Primary Examiner*—Lynda Salvatore
(74) *Attorney, Agent, or Firm*—Kenyon & Kenyon LLP

(57) ABSTRACT

The elastic fabric comprising a cross-linked polyolefin fiber, wherein the fabric has retractions both in warp-wise and weft-wise directions of the fabric of 8% or less after treated by dry heat at 65° C. for 30 minutes is disclosed. Also disclosed is a process for producing an elastic fabric, comprising: retracting a fabric comprising a cross-linked polyolefin fiber while dyeing the fabric, and then stretching or relaxing the fabric at a stretch ratio of 15% or less to finish the fabric with heat-setting. The present invention relates to an elastic fabric having an excellent chemical resistance and an excellent dimensional stability in the form of a product, which is suitably used for sporting fabrics such as swimming suits, leotards and the like, inner fabrics for ladies as well as outer fabrics, for example.

8 Claims, No Drawings

ELASTIC FABRIC AND PROCESS FOR PRODUCING THE SAME

This is a division of application Ser. No. 10/521,251 filed 4 Aug. 2005, now abandoned, which is a 371 national phase application of PCT/JP2003/009077 filed 17 Jul. 2003, claiming priority to Japanese Application No. 2002-209860 filed 18 Jul. 2002, the contents of which are incorporated herein by reference.

TECHNICAL FIELD

The present invention relates to an elastic fabric excellent in chemical resistance and in dimensional stability as a finished product and thus can be suitably used for sporting fabrics such as swimming suits, leotards and the like, inner fabrics for ladies as well as outer fabrics, for example.

BACKGROUND ART

Elastic fabrics using a polyurethane (UREA) elastic fiber (spandex) are widely used for a garments field etc. from the outstanding stretch properties. In recent years, various properties, for example, chemical resistance etc., have come to be, required with diversification of a use besides the stretch properties.

However, the chemical resistance of the spandex is generally poor due to its molecular structure as compared with the other materials. For example, brittleness caused by chlorine in a swimming suit use or by lipids in an inner use develops quickly. Hence, the spandex in relation to these applications has problems in that a product life is shortened by being used.

Although solution by adding additives in the spandex is tried to such problems, the essential properties which the spandex has are not adjusted and sufficient effects are not acquired in the present circumstances.

An elastic fabric using a novel polymer, polyolefin, disclosed in JP-A-08-509530 as an elastic fiber can be contemplated to essentially solve these problems. Such a polymer is excellent in chemical resistance due to its molecular structure and thus can essentially solve the aforementioned problems.

However, the fiber produced from such a polymer is treated by cross-linking to provide it with appropriate physical properties and thus it is very difficult to retain in a product the effect of heat setting applied during the secondary processing of the fabric. The fiber is so poor in dimensional stability that it retracts by laundry and the like after becoming a product.

DISCLOSURE OF INVENTION

The object of the present invention is to solve such problems hitherto existing and thus provide an elastic fabric excellent in dimensional stability and process for producing the same, using a polyolefin elastic fiber.

To overcome foregoing problems, the present inventors have intensively studied and finally found that, in consideration of the properties of the polyolefin fiber of cross-linking type, although the conventional fabric comprising spandex should be heated in a state of being largely stretched during heat setting process, dyeing process and the like, with noting that the elastic fabric is made to be relaxed in stead, by making the composition of the elastic fabric appropriate, the object of the present invention could be achieved. And thus the present invention could be accomplished.

The present invention relates to an elastic fabric satisfying the following conditions and the process for producing the same.

1. An elastic fabric comprising a crosslinked polyolefin fiber, wherein the fabric has retractions both in warpwise and weftwise directions of the fabric of 8% or less after treated by dry heat at 65° C. for 30 minutes.
2. A process for producing an elastic fabric, comprising:
   retracting a fabric comprising a crosslinked polyolefin fiber while dyeing the fabric, and then
   stretching or relaxing the fabric at a stretch ratio of 15% or less to finish the fabric with heat-setting.

BEST MODE FOR CARRYING OUT THE INVENTION

The elastic fabric according to the present invention is an elastic fabric comprising a crosslinked polyolefin fiber, wherein the fabric has retractions both in warpwise and weftwise directions of the fabric of 8% or less after treated by dry heat at 65° C. for 30 minutes. The retractions are preferably 5% or less, more preferably 3% or less. This elastic fabric has an effect of preventing the generation of wrinkles and deformation caused by the size change when it is processed or used after becoming a final product.

When the retraction is higher than 8%, defects such as the generation of wrinkles can be caused in the process after dyeing or at the stage of sewing and the like. In addition, also after the fabric becomes a final product, the dimensional stability of the final product may be harmed since the fabric can retract in a tumble dryer for home use and the like.

The elastic fabric according to the present invention, the mix rate of the crosslinked polyolefin fiber is preferably 50% or less based on the weight of the elastic fabric. More preferably, the mix rate is 40% or less. In order to maintain the elastic stress and the elastic recovery, the mix rate of the crosslinked polyolefin fiber is preferably 3% or more, based on the weight of the elastic fabric.

When the mix rate of the crosslinked polyolefin fiber exceeds 50%, sufficient dimensional stability may not be obtained since the influence of the retract behavior of elastic fibers is large.

The elastic fabric according to the present invention is capable of stretching 5% or more in the running direction of weaving or knitting of the crosslinked polyolefin fiber. More preferably, the elastic fabric is capable of stretching 7% or more.

The running direction of weaving or knitting of the polyolefin fiber here is referred to, for example in the case of a woven fabric, as the running direction of a warp when the elastic fiber used is a warp, and as the running direction of a weft when the elastic fiber is included in the wefts. In addition, in the case of a knitted fabric, the running direction is referred to as warp direction for warp knitting and as weft direction for weft knitting.

When the stretch ratio is lower than 5%, it may become difficult to obtain the product which fully satisfies a consumer. For example, a follow-up property to the body may become poor when such products as garments are made from the fabrics. When the stretch ratio exceeds 28%, the stretch recovery rate may decrease.

The crosslinked polyolefin fiber in the context of the present invention is referred to as a polyolefin fiber treated with crosslinking. The polyolefin in the context of the present invention is a homopolymer or a copolymer of olefin based monomer(s) such as ethylene, propylene, 1-octene. Examples include polyethylene, polypropylene, a copolymer of ethylene and α-olefin and the like. Here, α-olefin is, for example, propylene, 1-buthene, 1-hexene, 1-octene or the like.

The polyolefin fiber according to the present invention may be composed of a substantially linear polyolefin containing a branch and the polyolefin may be treated with crosslinking. In this case, it is preferable that the branch is homogeneous.

The homogeneous branch here means that a degree of the branch of the aforementioned polyolefin is homogeneous. Examples of these crosslinked polyolefin fiber include, for example, fibers composed of low-density polyethylene copolymerized with α-olefin and elastic fibers described in JP-A-8-509530.

Methods for crosslinking treatment include, for example, chemical crosslinkings where radical initiators or coupling agents etc. are used, and the methods performing the crosslinkings by irradiating an energy line. The methods performing the crosslinkings by irradiating an energy line is preferable in view of the stability after products are made therefrom, without limiting the scope of the present invention.

The elastic fabric according to the present invention may be produced by retracting a gray fabric comprising a crosslinked polyolefin fiber at least as a part in a dyeing-process, and then stretching or relaxing the fabric at a stretch ratio of 15% or less to finish the fabric with heat-setting, alternatively without finishing the fabric with heat-setting.

The production method mentioned relates to the method where the residual heat retraction included in the gray fabric of an elastic fabric is eliminated in a dyeing process and then treated so that the residual heat retraction in the product is not left. In particular, the dyeing treatment is desirably conducted at a temperature of 80 to 150° C. for 30 to 120 minutes with a stretch ratio of 15% or less. The residual heat retraction mentioned here is referred to as a capability or a property that a fabric can retract when heated in the form of an intermediate product or a product.

The stretch ratio at the time of finishing with heat-setting is preferably 1% or higher in view of wrinkles on the fabric and so on. Further preferably the stretch ratio is in the range of 2% to 5%. The fabric obtained is particularly suitable for fabrics for sports, such as bathing costumes, leotards and the like. The process of finishing with heat-setting mentioned may also be omitted.

It is because the characteristics demanded by consumers may be achieved depending on the configuration of the fabric even when the process is omitted, as long as the residual heat retraction is fully eliminated in a dyeing process. The fabric obtained is particularly suitable for women's inner fabrics.

In obtaining the elastic fabric according to the present invention, the relaxation and heat-treatment process for the fabric after dyeing may be further applied before or after the finishing process mentioned, so as to retract the fabric. It is because the application of such s process allows the elimination of the residual heat retraction to be ensured.

Further in the present invention, the process of finishing with heat-setting after the dyeing process or the relaxation and heat-treatment process mentioned above can be omitted. It is because the products which satisfy the consumers can be obtained merely by the dyeing process and the relaxation and heat-treatment process mentioned above.

The elastic fabric according to the present invention is referred to as two- or three-dimensional structures produced by using fibers, which include, for example, knitted webs, woven materials, non-woven materials and the like, although limiting the scope of the present invention.

EXAMPLES

Hereinafter, the present invention will be explained in more detail by way of Examples, which, however, should not be construed as limiting the scope of the present invention in any way. What is simply indicated to be % is based on weight. The measuring and evaluating methods in relation to structures in the Examples were conducted as follows.

(Number of Wales and Number of Courses)

Number of wales and number of courses were determined by measuring each of them per 2.54 cm of a fabric using a Lunometer from Taiyo Keiki Co., Ltd.

(Retraction)

Each of the three test pieces having a size of 25 cm×25 cm were first cut out from a fabric to be evaluated. In the center of each piece a square having a size of 20 cm×20 cm was drawn as a measuring face. In this case each side of the square was adjusted to the warp direction or the weft direction of the fabric. The samples were then placed without folding in the dry heat oven (Baking Tester DK-1M from Daiei Kagaku Seiki MFG Co., Ltd.), which is set at the temperature of 65° C. to carry out a heat treatment.

The samples were taken out of the oven in 30 minutes and left to cool. After that, each length of four sides of the measuring face was determined to calculate the retraction in the following way.

$$\text{Retraction (\%)}=[20-(\text{length of the side after heat treatment in cm})]\times 100/20$$

(Stretch Ratio)

The stretch ratio was determined, based on the method for measuring an elongation under constant load in conformity with JIS L 1018, by measuring the elongation in average corresponding to two sides of the length direction of the fabric and the elongation in average corresponding to two sides of the direction perpendicular to the length direction.

The cutstrip method was used for the measurement, with the sample piece size of 5 cm (width)×20 cm (length), the test width of 5 cm, the chuck distance of 20 cm and the initial load of 0.98 N per 1 cm width.

(Stretch Modulus)

The stretch modulus was determined in conformity with JIS L 1018-B (constant load method).

The cutstrip method was used for the measurement, with the sample piece size of 5 cm (width)×20 cm (length), the test width of 5 cm, the chuck distance of 20 cm and the load of 0.98 N per 1 cm width.

Example 1

The production of the fabrics used in the Examples was conducted in the following way.

The polyester fiber with 84 decitex and 36 filaments (available as the trade name of TOYOBO polyester) and the crosslinked polyolefin fiber (available as the trade name of Dow-XLA) which was obtained by radiation-crosslinking a melt-spinned fiber composed of an α-olefin copolymerized polyethylene with 45 decitex and 1 filament were first knitted with a circular knitting machine having 28 gauges per 2.54 cm and a pot diameter of 76.2 cm to form a tubular knitted fabric with 36 wales and 62 courses. The mix rate of the crosslinked polyolefin fiber in this case was 17%.

Then this tubular knitted fabric was scoured at 70° C. for 20 minutes, air-dried, and then subjected to a preset at 190° C. for 1 minute. The stretch ratios at the time of the preset were 20% both in the warp direction and the weft direction, based on the sample after scouring.

Dyeing operations were carried out at 130° C. by conventional procedure to the obtained fabric.

Dyeing formulations are shown below in detail. Dyeing machine MINI-COLOR "MC12EL" from Texam Giken Co., Ltd was used for the test.

Agent

Dyestuff: Dianix Black BG-FS 200% (Clariant KK.) 5% owf

Acetic Acid: 0.5 g/L

Level Dyeing Agent: Mignol 802 (Ipposha Oil Industries Co., Ltd.) 1 g/L

Bath ratio: 50:1

Temperature conditions: Bath temperature was maintained at 40° C. for 5 minutes and then increased at a rate of 2° C. per every minute up to 130° C., maintained at 130° C. for 60 minutes and then quenched. The dyed fabric obtained was subjected to a reduction cleaning at 80° C. for 20 minutes, air-dried, and then the fabric before finishing treatment with heat was obtained. The fabric obtained had a density of 59 wales and 98 courses.

A retraction, a stretch ratio and a stretch modulus were determined, using the obtained fabric as itself. The results are shown in Table 1.

The obtained fabric had the retraction of 0.1% in the warp direction and 0% in the weft direction. The fabric was very high in dimensional stability since it fully shrank in the dyeing process. In addition, both the stretch ratio and the stretch modulus were very high.

Example 2

The fabric before finishing treatment with heat described in Example 1 was finished with heat treatment at 170° C. for 1 minute by stretching 3% in each of the warp direction and the weft direction to form a fabric with 56 wales and 95 courses.

A retraction, a stretch ratio and a stretch modulus of the obtained fabric were determined. The results are shown in Table 1.

The obtained fabric had the retraction of 1.1% in the warp direction and 0.2% in the weft direction and was very high in dimensional stability as in the case of Example 1. In addition, both the stretch ratio and the stretch modulus were very high.

Example 3

The fabric before finishing treatment with heat described in Example 1 was finished with heat treatment at 170° C. for 1 minute by stretching 10% in each of the warp direction and the weft direction to form a fabric with 53 wales and 90 courses.

A retraction, a stretch ratio and a stretch modulus of the obtained fabric were determined. The results are shown in Table 1.

The obtained fabric had the retraction of 3.3% in the warp direction and 3.4% in the weft direction and was very high in dimensional stability as in the case of Example 1. In addition, both the stretch ratio and the stretch modulus were very high.

Example 4

The fabric after finishing treatment with heat described in Example 1 was subjected to retraction treatment by placing it under free of stretch for two minutes in the oven controlled at 150° C. to form a fabric with 58 wales and 97 courses.

A retraction, a stretch ratio and a stretch modulus of the obtained fabric were determined. The results are shown in Table 1.

The obtained fabric had the retraction of 0.5% in the warp direction and 0.4% in the weft direction and was very high in dimensional stability as in the case of Example 1. In addition, both the stretch ratio and the stretch modulus were very high.

Example 5

The fabric after finishing treatment with heat described in Example 1 was fixed by relaxing 10% in each of the warp direction and the weft direction, and then subjected again to finishing treatment with heat at 170° C. for one minute to form a fabric with 55 wales and 94 courses.

A retraction, a stretch ratio and a stretch modulus of the obtained fabric were determined. The results are shown in Table 1.

The obtained fabric had the retraction of 1.3% in the warp direction and 0.5% in the weft direction and was very high in dimensional stability as in the case of Example 1. In addition, both the stretch ratio and the stretch modulus were very high.

Example 6

Next, the fabric before finishing treatment with heat described in Example 1 was subjected to retraction treatment by placing it under free of stretch for two minutes in the oven controlled at 150° C. to form a fabric with 59 wales and 98 courses.

A retraction, a stretch ratio and a stretch modulus of the obtained fabric were determined. The results are shown in Table 1.

The obtained fabric had the retraction of 0.01% in the warp direction and 0.1% in the weft direction and was very high in dimensional stability as in the case of Example 1. In addition, both the stretch ratio and the stretch modulus were very high.

Example 7

The fabric before finishing treatment with heat described in Example 1 was finished with heat treatment at 170° C. for 1 minute by stretching 15% in each of the warp direction and the weft direction to form a fabric with 50 wales and 85 courses.

A retraction, a stretch ratio and a stretch modulus of the obtained fabric were determined. The results are shown in Table 1.

The stretch ratio and the stretch modulus of the obtained fabric were very high, while the dimensional stability was a little bit poor since the retraction was 6.0% in the warp direction and 5.2% in the weft direction.

However, the obtained fabric was sufficiently applicable to undergarments.

Example 8

The experiment was conducted substantially in the same manner as in Example 1, except that the dyeing temperature was 100° C., to form the fabric before finishing treatment with heat having 51 wales and 86 courses.

A retraction, a stretch ratio and a stretch modulus of the obtained fabric were determined. The results are shown in Table 1.

The stretch ratio and the stretch modulus of the obtained fabric were very high, while the dimensional stability was poor since the retraction was 5.3% in the warp direction and 5.2% in the weft direction.

However, the obtained fabric was sufficiently applicable to undergarments.

Example 9

Next, the fabric before finishing treatment with heat described in Example 8 was subjected to retraction treatment by placing it under free of stretch for two minutes in the oven controlled at 150° C. to form a fabric with 59 wales and 98 courses.

This fabric was finished with heat treatment at 170° C. for 1 minute by stretching 10% in each of the warp direction and the weft direction to form a fabric with 54 wales and 91 courses.

A retraction, a stretch ratio and a stretch modulus of the obtained fabric were determined. The results are shown in Table 1.

The obtained fabric had the retraction of 3.3% in the warp direction and 3.2% in the weft direction and was very high in dimensional stability. In addition, both the stretch ratio and the stretch modulus were very high.

TABLE 1

| | | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|
| Before finishing treatment with heat | Number of wales | 59 | 59 | 59 | 59 | 59 | 51 | 59 | 51 | 51 |
| | Number of courses | 98 | 98 | 98 | 98 | 98 | 86 | 98 | 86 | 86 |
| Rate of finishing treatment with heat (%) | warp | N/A | 3 | 10 | | | | 15 | | 10 |
| | weft | N/A | 3 | 10 | | | | 15 | | 10 |
| Rate of relaxation setting (%) | warp | N/A | N/A | N/A | N/A | 10 | N/A | N/A | N/A | N/A |
| | weft | N/A | N/A | N/A | N/A | 10 | N/A | N/A | N/A | N/A |
| Retraction treatment | | N/A | N/A | N/A | Applied | N/A | Applied | N/A | N/A | Applied |
| Retraction (%) | warp | 0.1 | 1.1 | 3.3 | 0.5 | 1.3 | 0.1 | 6.0 | 5.3 | 3.3 |
| | weft | 0 | 0.2 | 3.4 | 0.4 | 0.5 | 0.1 | 5.2 | 5.2 | 3.2 |
| Stretch ratio (%) | warp | >10 | >10 | >10 | >10 | >10 | >10 | >10 | >10 | >10 |
| | weft | >10 | >10 | >10 | >10 | >10 | >10 | >10 | >10 | >10 |
| Stretch modulus (%) | warp | >50 | >50 | >50 | >50 | >50 | >50 | >50 | >50 | >50 |
| | weft | >50 | >50 | >50 | >50 | >50 | >50 | >50 | >50 | >50 |

INDUSTRIAL APPLICABILITY

There can be provided a fabric which is capable of forming a product having an excellent dimensional stability when an elastic fiber comprising a crosslinked polyolefin is used. The fabric according to the present invention can be suitably used for sporting fabrics such as swimming suits, leotards and the like, inner fabrics for ladies as well as outer fabrics, for example.

The invention claimed is:

1. A process for producing an elastic fabric, comprising:

retracting a fabric comprising a cross-linked polyolefin fiber while dyeing the fabric, and stretching or relaxing the fabric at a stretch ratio of 15% or less to finish the fabric with heat-setting.

2. A process for producing an elastic fabric, comprising:

retracting a fabric comprising a cross-linked polyolefin fiber while dyeing the fabric, without finishing the fabric with heat-setting before or after retracting.

3. A process for producing an elastic fabric according to claim 1, comprising:

retracting a fabric comprising a cross-linked polyolefin fiber while dyeing the fabric, subjecting the fabric to a process of heat treatment with relaxation for retracting the fabric, and finishing the fabric with heat-setting.

4. A process for producing an elastic fabric according to claim 2, comprising:

retracting a fabric comprising a cross-linked polyolefin fiber while dyeing the fabric, and subjecting the fabric to a process of heat treatment with relaxation for retracting the fabric.

5. An elastic fabric made according to the process of claim 1.

6. An elastic fabric made according to the process of claim 2.

7. An elastic fabric made according to the process of claim 3.

8. An elastic fabric made according to the process of claim 4.

* * * * *